US009643760B2

(12) United States Patent
Choi

(10) Patent No.: US 9,643,760 B2
(45) **Date of Patent: *May 9, 2017**

(54) CAP STRUCTURE FOR VESSEL

(71) Applicant: Jong-Suh Choi, Hwaseong-si (KR)

(72) Inventor: Jong-Suh Choi, Hwaseong-si (KR)

( * ) Notice: Subject to any disclaimer, the term of this patent is extended or adjusted under 35 U.S.C. 154(b) by 645 days.

This patent is subject to a terminal disclaimer.

(21) Appl. No.: 14/152,809

(22) Filed: Jan. 10, 2014

(65) Prior Publication Data

US 2015/0136773 A1 May 21, 2015

(30) Foreign Application Priority Data

Nov. 20, 2013 (KR) ..... 10-2013-0141135
Nov. 20, 2013 (KR) ..... 10-2013-0141139
Dec. 6, 2013 (KR) ..... 10-2013-0151047
Dec. 27, 2013 (KR) ..... 10-2013-0165285

(51) Int. Cl.

| | |
|---|---|
| ***B65D 51/18*** | (2006.01) |
| ***B65D 39/08*** | (2006.01) |
| ***B65D 55/02*** | (2006.01) |
| ***B65D 50/06*** | (2006.01) |
| ***B65D 51/32*** | (2006.01) |
| *A45D 34/00* | (2006.01) |

(52) U.S. Cl.

CPC ..... *B65D 51/18* (2013.01); *B65D 39/08* (2013.01); *B65D 50/062* (2013.01); *B65D 51/32* (2013.01); *B65D 55/02* (2013.01); *A45D 34/00* (2013.01)

(58) Field of Classification Search

CPC ..... B65D 39/08; B65D 50/062; B65D 51/18; B65D 51/32; B65D 55/02; B01L 3/00; B01L 3/0241; B01L 3/0272; A45D 34/00; A45D 34/04; A45D 2200/058

USPC ..... 220/212, 254.1, 254.7–254.9, 255, 220/259.3–259.4, 259.5, 787, 800; 215/216, 220, 228; 222/546, 549–551, 222/556–557; 141/22–24, 112, 380–381; 422/934; 604/82, 89, 294

See application file for complete search history.

(56) References Cited

U.S. PATENT DOCUMENTS 3,101,751 A * 8/1963 Ballin ..... B01L 3/0282 141/24
3,881,624 A * 5/1975 Dougherty, Sr. .... B65D 50/046 141/24

(Continued)

*Primary Examiner* — J. Gregory Pickett
*Assistant Examiner* — Brijesh V. Patel
(74) *Attorney, Agent, or Firm* — Novick, Kim & Lee, PLLC; Jae Youn Kim

(57) ABSTRACT

Provided is a cap structure of a vessel, which is coupled with the vessel to close or open the vessel. The cap structure includes an inner cap having a cylindrical shape and coupled with an upper end portion of the vessel to open or close the vessel, an outer cap having a cylindrical shape and fitted around an outer-diameter surface of the inner cap such that the outer cap is coupled with the inner cap, a component inserted into the outer cap and the inner cap, and a detachable unit to fixedly couple the component with the inner cap or the outer cap or separate the component from the inner cap or the outer cap without separating the inner cap or the outer cap from the vessel. The cap opens or closes the vessel by fixedly attaching the component to the cap disassembled from the vessel or separating the component from the cap.

5 Claims, 15 Drawing Sheets

(56) References Cited

U.S. PATENT DOCUMENTS

| | | | | | |
|---|---|---|---|---|---|
| 4,286,633 | A * | 9/1981 | Herr | B65D 50/041 | 141/24 |
| 4,383,618 | A * | 5/1983 | Dougherty | B65D 50/046 | 215/216 |
| 4,633,922 | A * | 1/1987 | Fabbro | B65D 41/48 | 141/24 |
| 4,768,682 | A * | 9/1988 | Friedrich | B65D 41/06 | 215/222 |
| 7,874,461 | B2 * | 1/2011 | Bae | B05B 11/0032 | 222/153.11 |
| 8,308,029 | B2 * | 11/2012 | Ki | B05B 11/0027 | 222/153.13 |
| 2013/0074983 | A1 * | 3/2013 | Choi | A45D 34/04 | 141/23 |
| 2014/0020789 | A1 * | 1/2014 | Duquet | A45D 34/04 | 141/24 |
| 2014/0209206 | A1 * | 7/2014 | Wang | G01F 11/084 | 141/24 |
| 2015/0059923 | A1 * | 3/2015 | Kim | A45D 34/04 | 141/110 |
| 2015/0108171 | A1 * | 4/2015 | Kim | B05B 11/3001 | 222/321.3 |
| 2015/0158640 | A1 * | 6/2015 | Choi | B65D 51/32 | 220/255 |
| 2015/0158641 | A1 * | 6/2015 | Choi | B65D 51/18 | 220/255 |
| 2015/0367367 | A1 * | 12/2015 | Lefevre | B65D 50/065 | 222/153.13 |

* cited by examiner

PRIOR ART

CAP STRUCTURE FOR VESSEL

BACKGROUND OF THE INVENTION

1. Field of the Invention

The present invention relates a cap structure for a vessel. In particular, the present invention relates to a cap structure for a vessel, capable of opening/closing the vessel by fixedly attaching a component to the cap, or separating the component from the cap to open the vessel in the state that the cap is not separated from the vessel.

2. Description of the Related Art

In general, to continuously open/close a cap coupled with a vessel with respect to the vessel, a screw-coupling structure is employed.

However, the conventional screw-coupling structure requires a user to inconveniently rotate the cap several times in order to open/close the cap. However, whenever the cap is open/closed, the cap must be inconveniently rotated each time.

Meanwhile, for example, when the vessel is employed for a vessel of cosmetics, as shown in FIG. 1, a cap 3 may be coupled with a vessel 1 in a screw structure, and a pipette, a mascara stick or the like may be coupled integrally with the cap 3.

In this case, when a user intends to use a cosmetic liquid contained in the vessel 1, the user must inconveniently separate the cap 2 from the vessel 1 as shown in FIG. 1 by rotating the cap 2 several times for the use of a material contained in the vessel 1.

Therefore, when a pipette, a mascara stick, or a mascara brush integrated with the cap 3 is used in the separated state from the vessel 1, the user must use the pipette, the mascara stick or the mascara brush having a low end portion spaced apart from the floor of the vessel 1 by a predetermined distance, so that the user does not use liquid remaining on the floor of the vessel 1 by using the pipette, so the user must overturn the vessel 1 and directly apply the liquid to a palm or an affected area of the user. Accordingly, high-price cosmetics may be wasted.

SUMMARY OF THE INVENTION

Accordingly, the present invention has been made keeping in mind the above problems occurring in the prior art, and the present invention provides a cap structure for a vessel, capable of opening/closing the vessel by fixedly attaching components to the cap or separating the components from the cap in the state that the cap is disassembled from the vessel.

In order to accomplish the above object, there is provided a cap structure of a vessel, which is coupled with the vessel to close/open the vessel. The cap structure includes an inner cap having a cylindrical shape and coupled with an upper end portion of the vessel to open/close the vessel, an outer cap having a cylindrical shape and fitted around an outer-diameter surface of the inner cap such that the outer cap is coupled with the inner cap, a component inserted into the outer cap and the inner cap, and a detachable unit to fixedly couple the component with the inner cap or the outer cap or separate the component from the inner cap or the outer cap without separating the inner cap or the outer cap from the vessel.

In this case, preferably, the detachable unit includes at least one fixing groove formed by downward incising an upper end portion of the inner cap with predetermined width and depth, and a fixing guiding surface curved or obliquely provided and gradually enlarged from an outer-diameter surface toward an inner-diameter surface of an incised surface, an operating part having a cylindrical shape, slidably inserted into an inner diameter of the inner cap, having at least one guiding groove formed by downward incising an upper end portion of the operating part with predetermined width and depth, and having support holes formed in both lateral sides of the guiding groove while passing through inner and outer diameters of the operating part at a predetermined depth, a driving part inserted into the guiding groove of the operating part to reciprocate toward the fixing groove and a center of the operating part, and having support parts protruding in an arc shape from both lateral sides of the driving part such that the support parts are inserted into the support holes, a reciprocating member to reciprocate the operating part, and a detachable member to lock the component or release a locking state of the coupling part.

In addition, preferably, the reciprocating member includes at least one guiding hole having an insertion hole obliquely or vertically extending downward from the upper end portion of the inner cap, and a driving hole horizontally or obliquely extending to one side from the insertion hole, at least one guiding protrusion protruding from the outer-diameter surface of the operating part at a position corresponding to a position of the guiding hole such that the guiding protrusion is inserted from an inside to an outside of the guiding hole while protruding out of the guiding hole, a driving groove extending vertically upward from a lower end portion of an inner-diameter surface of the outer cap such that the guiding protrusion protruding through the guiding hole is inserted into the driving groove, a moving guiding surface formed at one outer surface of the driving part corresponding to the fixing guiding surface of the inner cap such that the moving guiding surface makes sliding-contact with the fixing guiding surface, an elastic member having elasticity to push the driving part outward from a circumferential center, a first fitting groove formed in the inner-diameter surface of the operating part such that the elastic member is partially or entirely inserted into the first fitting groove, and a second fitting groove formed in an arc shape at an inner surface of the driving part such that a portion of the elastic member is fitted into the second fitting groove.

Further, preferably, the cap further includes a first stopper protruding from one side of the driving hole to prevent the guiding protrusion from being moved in a reverse direction after the guiding protrusion has been moved to the one side of the driving hole.

In addition, preferably, the cap further includes a second stopper protruding from the outer-diameter surface of the inner cap and vertically extending, and a vertical protrusion protruding from the inner-diameter surface of the outer cap while vertically extending to prevent the outer cap from being rotated in a reverse direction after the outer cap has been rotated in one direction and gone beyond the second stopper.

Besides, preferably, the reciprocating member includes at least one guiding hole having an insertion hole obliquely or vertically extending downward from the upper end portion of the inner cap, a driving hole horizontally or obliquely extending from the insertion hole, an up-and-down hole obliquely extending downward from an end portion of the driving hole, and a stopping hole horizontally extending from an end portion of the up-and-down hole, at least one guiding protrusion protruding from the outer-diameter surface of the operating part at a position corresponding to a position of the guiding hole such that the guiding protrusion is inserted from an inside to an outside of the guiding hole while protruding out of the guiding hole, a driving groove extending vertically upward from a lower end portion of an inner-diameter surface of the outer cap such that the guiding protrusion protruding through the guiding hole is inserted into the driving groove, a moving guiding surface formed at one outer surface of the driving part corresponding to the fixing guiding surface of the inner cap such that the moving guiding surface makes sliding-contact with the fixing guiding surface, an elastic member having elasticity to push the driving part outward from a circumferential center, a first fitting groove formed in the inner-diameter surface of the operating part such that the elastic member is partially or entirely inserted into the first fitting groove, and a second fitting groove formed in an arc shape at an inner surface of the driving part such that a portion of the elastic member is fitted into the second fitting groove.

In addition, preferably, the cap further includes a first stopper protruding from one side of the stopping hole to prevent the guiding protrusion from being moved in a reverse direction after the guiding protrusion has been moved to the one side of the stopping hole.

Further, preferably, the cap further includes a second stopper protruding from the outer-diameter surface of the inner cap and vertically extending, and a vertical protrusion protruding from the inner-diameter surface of the outer cap while vertically extending to prevent the outer cap from being rotated in a reverse direction after the outer cap has been rotated in one direction and gone beyond the second stopper.

Meanwhile, the detachable member includes at least one first detachable protrusion circumferentially protruding from an outer-diameter surface of the coupling part formed at a lower portion of the component, and a first detachable groove formed in an inner surface of the driving part to be fitted around the first detachable protrusion.

In addition, the detachable member includes at least one second detachable protrusion protruding from an inner surface of the driving part, and a second detachable groove circumferentially formed in an outer-diameter surface of the coupling part formed at a lower portion of the component.

Meanwhile, the detachable unit includes at least one fixing groove formed by downward incising an upper end portion of the inner cap with predetermined width and depth, and having a fixing guiding surface curved or obliquely provided and gradually enlarged from an outer-diameter surface toward an inner-diameter surface of an incised surface, an operating part having a cylindrical shape, slidably inserted into an inner diameter of the inner cap, having at least one guiding groove formed by downward incising an upper end portion of the operating part with predetermined width and depth, having support holes formed in both lateral sides of the guiding groove while passing through inner and outer diameters of the operating part at a predetermined depth, having a first inclined surface having a slop gradually narrowing the inner diameter in a wide-top and narrow-bottom shape, and having a support which is formed with a predetermined width at a peripheral portion of a through hole formed at a lower end portion of the operating part, a driving part inserted into the guiding groove of the operating part to reciprocate toward the fixing groove and a center of the operating part, having support parts protruding in an arc shape from both lateral sides of the driving part such that the support parts are inserted into the support holes, having a second inclined surface with a slop increasing the thickness thereof toward a lower portion of the driving part, and having a fourth detachable protrusion protruding from an inner lateral side, a reciprocating member to reciprocate the operating part, a connection inclined surface formed at an outer-diameter surface of the component and having a slope reducing a size of a diameter toward a lower portion of the connection inclined surface, and a fourth detachable groove circumferentially formed in the connection inclined surface.

In addition, the reciprocating member includes at least one guiding hole having an insertion hole obliquely or vertically extending downward from the upper end portion of the inner cap, a driving hole horizontally or obliquely extending from the insertion hole, an up-and-down hole obliquely extending downward from an end portion of the driving hole, and a stopping hole horizontally extending from an end portion of the up-and-down hole, at least one guiding protrusion protruding from an outer-diameter surface of the operating part at a position corresponding to a position of the guiding hole such that the guiding protrusion is inserted from an inside to an outside of the guiding hole while protruding out of the guiding hole, a driving groove extending vertically upward from a lower end portion of an inner-diameter surface of the outer cap such that the guiding protrusion protruding through the guiding hole is inserted into the driving groove, and a moving guiding surface formed at one outer surface of the driving part corresponding to the fixing guiding surface of the inner cap such that the moving guiding surface makes sliding-contact with the fixing guiding surface.

In addition, preferably, the cap structure further includes a first stopper protruding from one side of the driving hole to prevent the guiding protrusion from being moved in a reverse direction after the guiding protrusion has been moved to the one side of the driving hole.

Further, preferably, the cap structure further includes a second stopper protruding from the outer-diameter surface of the inner cap and vertically extending, and a vertical protrusion protruding from the inner-diameter surface of the outer cap while vertically extending to prevent the outer cap from being rotated in a reverse direction after the outer cap has been rotated in one direction and gone beyond the second stopper.

In addition, preferably, the detachable member includes a third detachable groove formed in an inner-diameter surface of the coupling part formed at a lower portion of the component, and a locking part protruding from a lower end portion of an inner surface of the driving part and bent upward such that the locking part is inserted into a lower inner diameter of the coupling part formed in the component downward inserted into the inner cap, and having a third detachable protrusion protruding from an upper end portion of the locking part such that the third detachable protrusion is inserted into the third detachable groove.

As described above, the present invention has following effects.

First, the component of the cap is fixedly locked or released from the locking state only by rotating the outer cap at a predetermined angle in a forward direction or a reverse direction, so that the component of the cap can be simply open/closed.

Second, the component is locked or released from the state that the component is not moved up and down, or locked or separated while being slightly moved up and down, so that the pumping tube of the pipette or the mascara stick or the mascara brush coupled with the component is closely provided to the floor of the vessel when the component is used. Accordingly, a most amount of cosmetics remaining on the floor of the vessel can be used.

Third, the component is designed to have a structure in which the component is fixedly locked or released from the locking state while the component is being moved up and down to appear. The component can be designed in the various shapes or various structures. Accordingly, the purchase need of a consumer can be increased.

DETAILED DESCRIPTION OF THE INVENTION

Hereinafter, the structure of a vessel 1, a component 100, an inner cap 200, and an outer cap 300, which are common components of first and second embodiments, will be described.

Although it is easy to couple the inner cap 200 having a cylindrical shape with an upper end portion of the vessel 1 according to the present invention through a screw coupling scheme, the present invention is not limited to the coupling scheme, but employs various typical coupling schemes.

Figure 1:
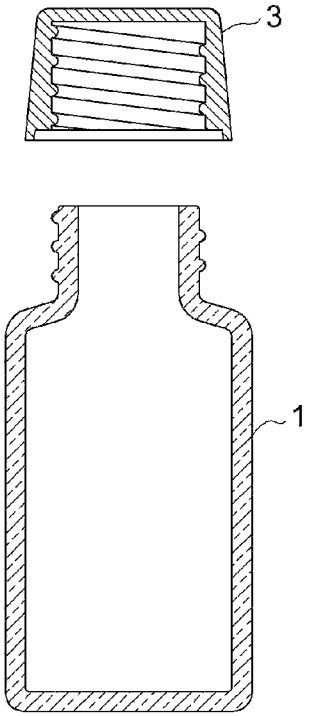
FIG. 1 is a sectional view showing the state that a component is separated from a vessel according to the related art.
Figure 2:
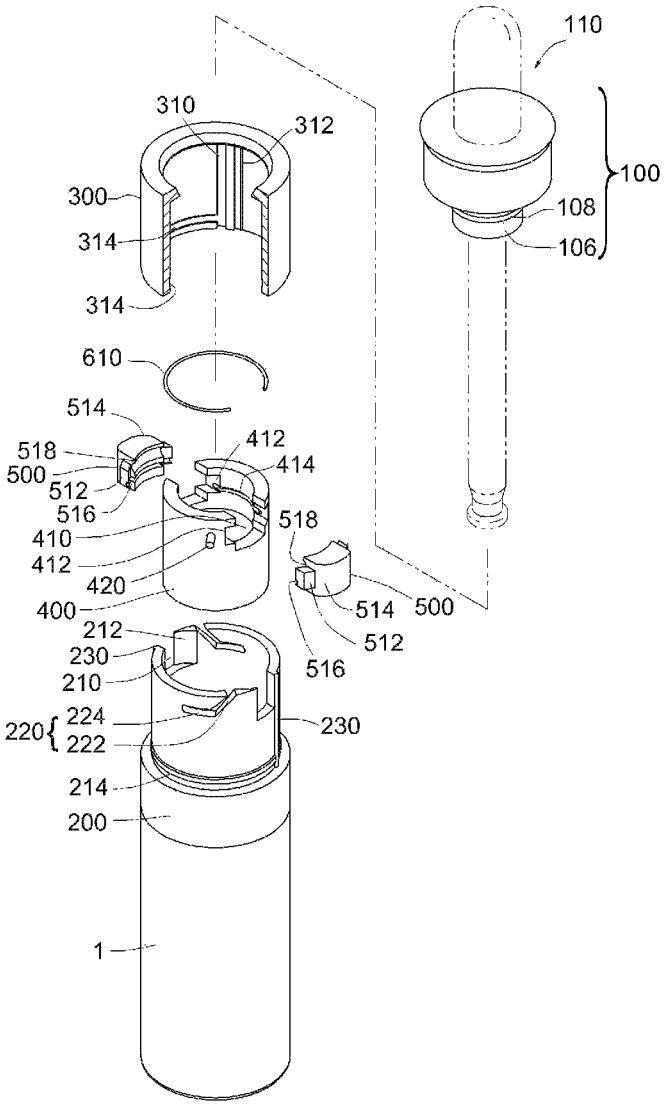
FIG. 2 is an exploded perspective view showing a constitution according to a first embodiment of the present invention.

As shown in FIG. 2, the outer cap 300 having a cylindrical shape is downward fitted around an outer-diameter surface of the inner cap 200. In this case, the outer cap 300 has a structure of freely rotating in the state that the outer cap 300 is coupled with the inner cap 200. Preferably, at least one fixing step 214 is circumferentially molded in the form of a protrusion on the outer-diameter surface of the inner cap 200, and a locking groove 314 is circumferentially molded in a lower end portion of an inner-diameter surface of the outer cap 300 so that the locking groove 314 is downward fitted around the fixing step 214. Accordingly, the present invention suggests a structure in which the locking groove 314 is fitted around the fixing step 314, so that the outer cap 300 can be freely rotated in the state that the outer cap 300 is coupled with the inner cap 200.

The component 100 has the shape of a cylinder inserted into an upper portion of the outer cap 300 having the cylindrical structure and downwardly inserted into an upper portion of the inner cap 200. The component 100 is provided at a lower portion thereof with the coupling part 106 molded in a cylindrical shape as shown in FIG. 2.

First Embodiment

Each embodiment relates to a detachable unit of fixedly coupling/separating the component 100 with/from the inner cap 200 or the outer cap 300 without separating the inner cap 200 or the outer cap 300 from the vessel 1 in the state that the inner cap 200 is coupled with the vessel 1 and the outer cap 300 is coupled with the outer portion of the inner cap 200.

Hereinafter, a preferable detachable unit according to the first embodiment will be described with reference to FIGS. 2 to 8.

As shown in FIG. 2, a fixing groove 210 is formed by downward incising an upper end portion of the inner cap 200 with predetermined width and depth, so that the inner and outer-diameter surfaces of the inner cap 200 have a perforated structure. In this case, a pair of fixing grooves 210 are preferably formed symmetrically to each other at the upper end portion of the inner cap 200.

In this case, one incised surface of the fixing groove 210 has a fixing guiding surface 212 formed in a structure chamfered in the form of a curved line or an oblique line from the outer-diameter surface toward the inner-diameter surface of the incised surface so that the fixing groove 210 is gradually enlarged to the inner-diameter surface of the inner cap 200.

In addition, the cylindrical operating part 400 is inserted into the inner cap 200. As shown in FIG. 2, at least one guiding groove 410 is formed by downward incising an upper end portion of the cylindrical operating part 400 with predetermined width and depth. Preferably, a pair of guiding grooves 410 are formed symmetrically to each other corresponding to positions of the fixing grooves 210. Support holes 412 are formed with a predetermined depth at both lateral sides of the guiding grooves 410, so that the inner and outer-diameter surfaces have a perforated structure.

Further, the driving part 500 is inserted into the guiding groove 410 of the cylindrical operating part 400 to reciprocate toward the center of the cylindrical operating part 400 and the fixing groove 210 of the inner cap 200. The driving part 500 is molded at both lateral sides thereof with support parts 512 in the form of a protrusion and the support parts 512 are inserted into the support holes 412 formed in both lateral sides of the guiding groove 410.

Accordingly, the driving part 500 can be prevented from being upward separated from the fixing groove 210 and the guiding groove 410 by the support hole 412.

A reciprocating member, which allows the driving part 500 to reciprocate toward the center of the operating part 400 and the fixing groove 210 of the inner cap 200, allows the driving part 500 to reciprocate by rotating the operating part 400 at a predetermined angle as follows.

First, as shown in FIG. 2, the inner cap 200 includes guiding holes 220 which have insertion holes 222 obliquely or vertically extending downward of the upper end portion of the inner cap 200, and driving holes 224 horizontally or obliquely extending to one side from the insertion holes 222 and are formed symmetrically to each other at the upper portion of the inner cap 200.

Further, the operating part 400 is provided on the outer-diameter surface thereof with guiding protrusions 420 molded at positions corresponding to those of the guiding holes 220 formed symmetrically to each other so that the guiding protrusions 420 protrude outward of the guiding holes 220.

A driving groove 310 is molded in the inner-diameter surface of the outer cap 300 in such a manner that an end portion of the guiding protrusion 420 protruding through the guiding hole 220 is inserted into the driving groove 310, while vertically extending from the lower end portion of the inner-diameter surface of the outer cap 300, thereby preventing the outer cap 300 from interfering with the guiding protrusion 420 inserted into the driving groove 310 when the outer cap 300 moves in a vertical direction in assembling.

Figure 5:
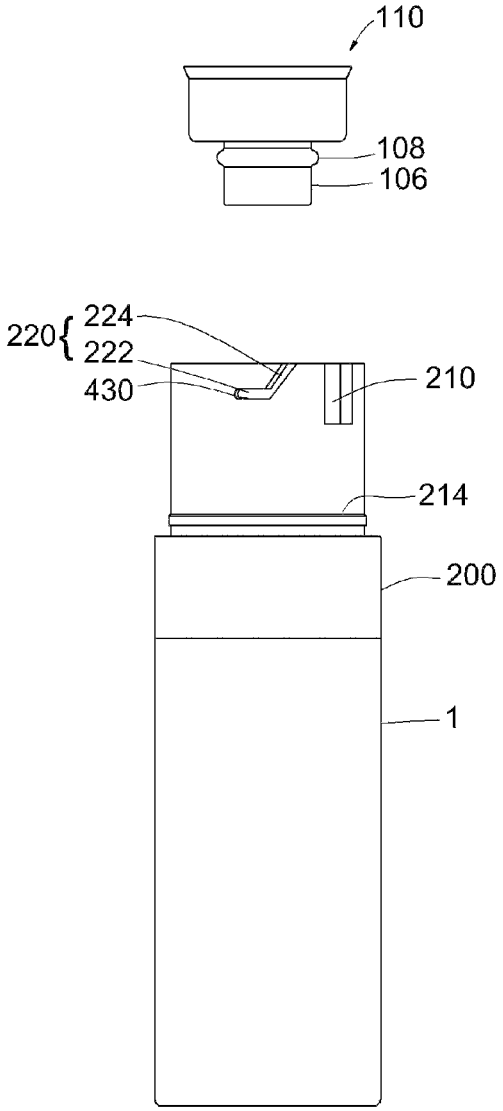
FIG. 5 is a front view showing a component separated from a vessel according to the first embodiment of the present invention.

In this case, as shown in FIG. 5, a first stopper 430 is preferably molded in the form of a protrusion at one side of the driving hole 224 to prevent the guiding protrusion 420 from being unintentionally moved by forcing the first stopper 430 to interfere with the guiding protrusion 420 when the guiding protrusion 420 is moved to one side of the driving hole 224 and then moved in a reverse direction.

Another embodiment of preventing the guiding protrusion 420 from being unintentionally moved in the reverse direction after being moved by a user is as follows.

Figure 4:
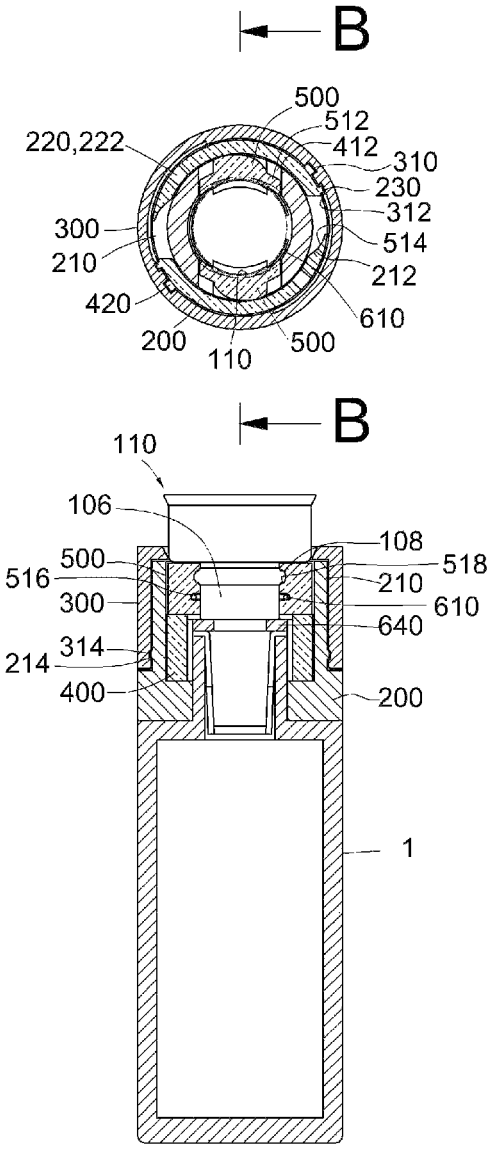
FIG. 4 illustrates a cross sectional view and a B-B line longitudinal sectional view showing that the component according to the first embodiment of the present invention is fixedly.

In other words, as shown in FIGS. 2 and 4, a second stopper 230 protrudes from the outer-diameter surface of the inner cap 200 and vertically extends.

In addition, a vertical protrusion 312 is molded in the from inner-diameter surface of the outer cap 300, so that the vertical protrusion 312 may extend vertically corresponding to the second stopper 230.

Accordingly, when the vertical protrusion 312 of the outer cap 300 is rotated in one direction to go beyond the second stopper 230 and then the guiding protrusion 420 or the outer cap 300 unintentionally attempts to be rotated in the reverse direction, the reverse rotation of the guiding protrusion 420 or the outer cap 300 can be prevented due to the interference between the second stopper 230 and the vertical protrusion 312.

A moving guiding surface 514 is formed at one outer surface of the driving part 500 corresponding to the fixing guiding surface 212 of the inner cap 200 so that the moving guiding surface 514 makes a sliding-contact with the fixing guiding surface 212 of the inner cap 200.

In addition, a first fitting groove 414 is circumferentially formed in an inner-diameter surface of the operating part 400, and an arc-shape second fitting groove 516 is circumferentially formed in an inner surface of the driving part 500, so that an elastic member 610 is fitted into the first and second fitting grooves 414 and 516, so the elasticity of the elastic member 610 is applied from the center of a circle toward the outer cap 300. Accordingly, force to push the driving part 500 outward from the center of a circle is applied to the driving part 500.

Therefore, most portions of the elastic member 610 having an open structure in the shape of "C" are inserted into the first fitting groove 414, and a less portion of the elastic member 610 is inserted into the second fitting groove 516.

Meanwhile, a detachable member to lock or release the component 100 inserted into the inner cap 200 has three examples.

First, a plurality of first detachable protrusions circumferentially protrude on the outer-diameter surface of the coupling part 106 formed at a lower portion of the component 100, or one first detachable protrusion 108 may be formed while circumferentially extending.

In addition, a first detachable groove 518 is formed in an inner surface of the driving part 500 so that the first detachable groove 518 may be fitted around the first detachable protrusion 108. Accordingly, if the driving part 500 is moved in the central direction as shown in FIG. 5, the first detachable groove 518 is fitted around the first detachable protrusion 108, so that the driving part 500 may be fixedly coupled with the component 100.

Figure 6:
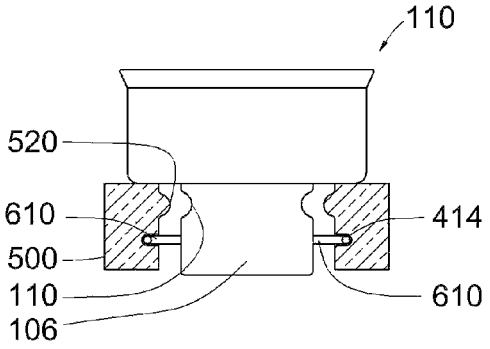
FIG. 6 is a view showing a detachable member according to the first embodiment of the present invention.

Second, as shown in FIG. 6, at least one second detachable protrusion 520 protrudes from the inner surface of the driving part 500, and a second detachable groove 110 is circumferentially formed in the outer-diameter surface of the coupling part 106 of the component 100. Accordingly, if the driving part 500 is moved in the central direction as shown in FIG. 5, the second detachable protrusion 520 is inserted into the second detachable groove 110, so that the driving part 500 may be fixedly coupled with the component 100.

Figure 7:
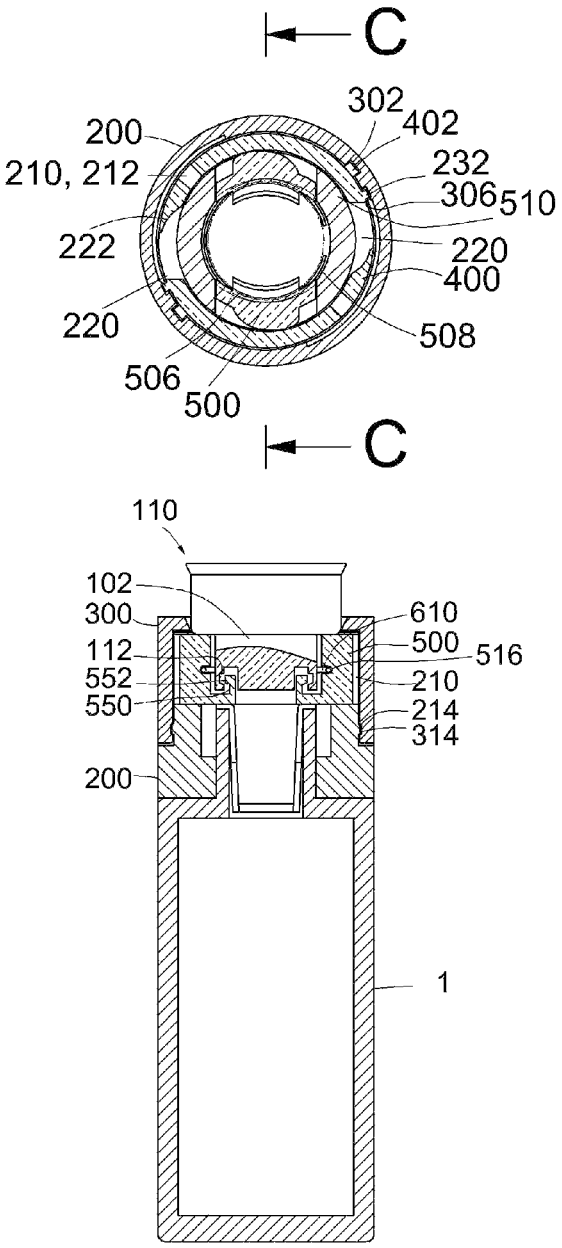
FIG. 7 illustrates a cross sectional view and a C-C line longitudinal sectional view showing another example of the detachable member according to the first embodiment of the present invention and a component separated from the vessel.
Figure 8:
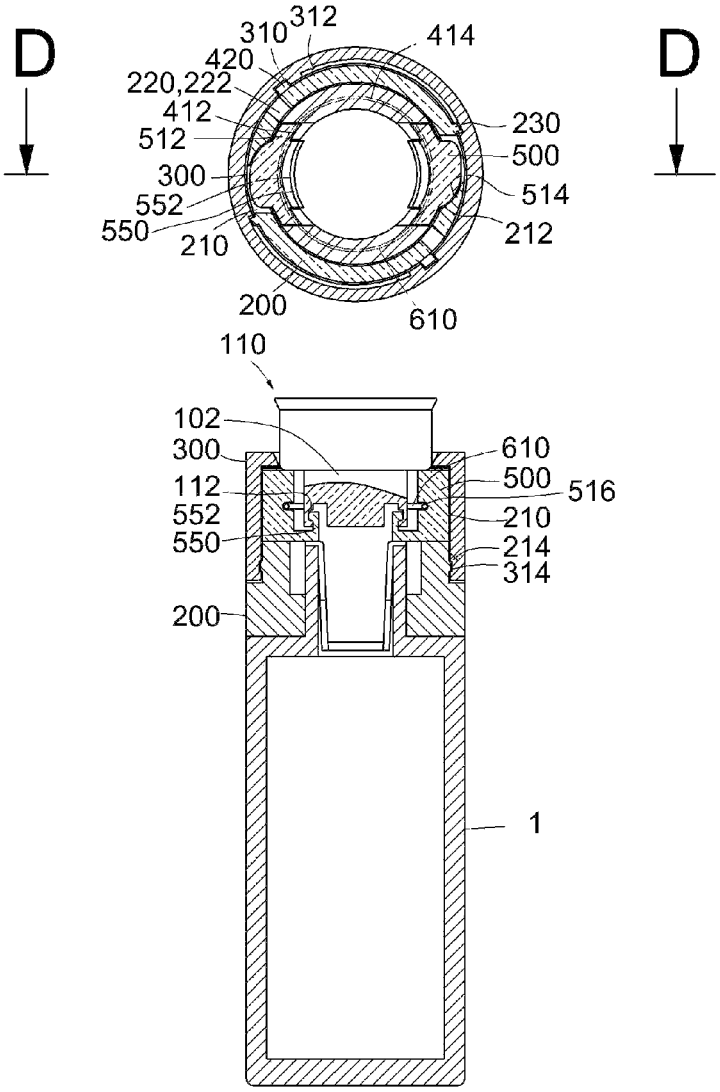
FIG. 8 illustrates a cross sectional view and a D-D line longitudinal sectional view showing still another example of the detachable member according to the first embodiment of the present invention and the component locked to the vessel.

Third, as shown in FIGS. 7 and 8, a third detachable groove 112 is circumferentially formed in the inner-diameter surface of the coupling part 106 of the component 100. A locking part 550 is molded in the form of a protrusion at a lower end portion of the inner surface of the driving part 500 and the end portion of the locking part 559 is bent upward so that the third detachable protrusion 552 formed on the inner surface of the driving part 500 is inserted into the lower inner-diameter of the coupling part 106 of the component 100 when the component 100 is downward inserted into the inner cap 200. A third detachable protrusion 552 is molded on the upper end portion of the locking part 550 such that the third detachable protrusion 552 is inserted into the third detachable groove 112. Accordingly, when the driving part 500 is moved toward the outer cap 300, the locking part 550 and the third detachable protrusion 552 inserted into the coupling part 106 are moved toward the outer cap 300 while being inserted into the third detachable groove 112 to fixedly lock the component 100.

Hereinafter, the operating state of the first embodiment having the above structure will be described with reference to FIGS. 3 to 8.

Figure 3:
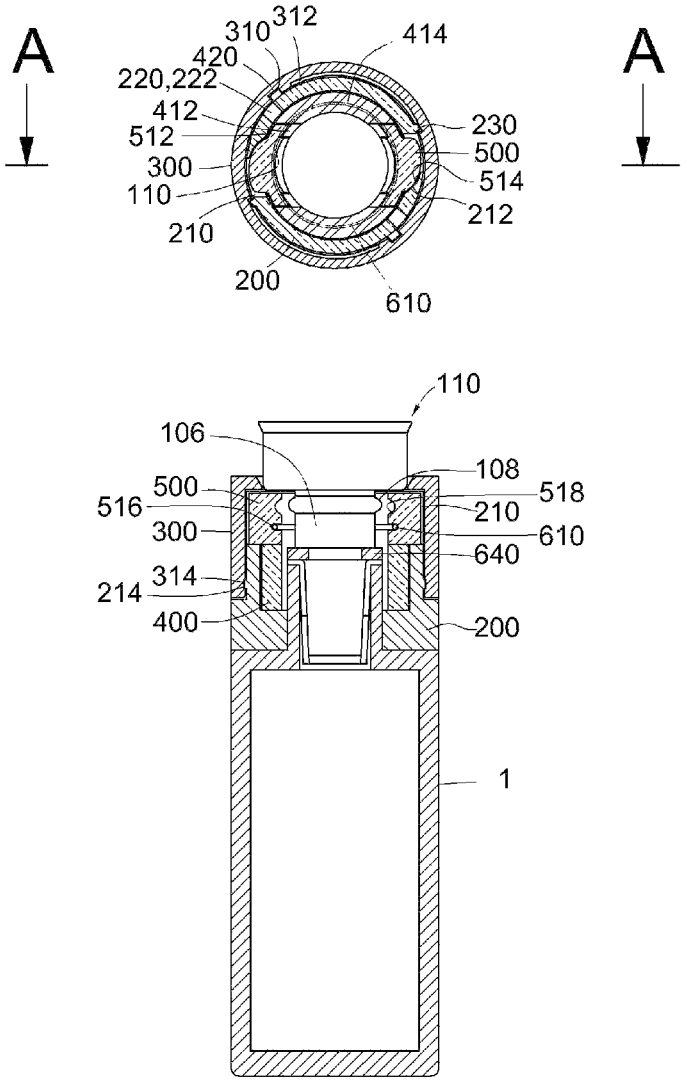
FIG. 3 illustrates a cross sectional view and an A-A line longitudinal sectional view showing that the component is separated from the vessel according to the first embodiment of the present invention.

First, as shown in a cross sectional view of FIG. 3, the driving part 500 is away from the center of the driving part 500 so that the first detachable groove 518 of the driving part 500 is separated from the first detachable protrusion 108 formed on the outer-diameter surface of the coupling part 106 of the component 100. In this state, the component 100 may be separated from the vessel 1 or the used component 100 may be inserted into the vessel 1.

Therefore, if the component 100 is inserted into the vessel 1 through the inner cap 200 in the state shown in FIG. 3, a lower end portion of the coupling part 106 is mounted on the upper end portion of a packing member 640, or the lower end portion of the component 100 is mounted on the upper end portion of the operating part 400 as shown in the longitudinal sectional surface of FIG. 3, so that the lower end portion of the pumping part 102 is maintained in a stationary state.

In this case, elastic member 610 elastically supports the driving part 500 in the state that the elastic member 610 is inserted into the first fitting groove 414 and the second fitting groove 516, so that the driving part 500 is away from the center. The end portion of the guiding protrusion 420 of the operating part 400 is located at a point at which the insertion hole 222 and the driving hole 224 of the guiding hole 220 meet together in the state that the end portion of the guiding protrusion 420 is fitted into the driving groove 310 of the outer cap 300.

Meanwhile, in order to fixedly lock the component 100 into the inner cap 200, as the guiding protrusion 420 fitted into the driving groove 320 is moved clockwise along the driving hole 224 by rotating the outer cap 300 clockwise as shown in FIG. 4, the operating part 400 is rotated clockwise together with the guiding protrusion 420.

Therefore, since the fixing guiding surface 212 of the fixing groove 210 is obliquely formed or curved, as the driving part 500 inserted into the guiding groove 410 of the operating part 400 is rotated clockwise by the operating part 400, the moving guiding surface 514 of the driving part 500 making contact with the fixing guiding surface 212 is guided along the fixing guiding surface 212 while rotating clockwise.

In this case, since the thickness of the fixing guiding surface 212 is gradually increased as shown in the cross sectional view of FIG. 3, the driving part 500 is gradually closer to the central part by the fixing guiding surface 212 while rotating.

In this case, if the guiding protrusion 420 is moved to the end portion of the driving hole 224 along the outer cap 300, the guiding protrusion 420 is maintained in a stop state by the first stopper 430 molded in the form of a protrusion at the driving hole 224 or by the interference between the vertical protrusion 312 of the outer cap 300 and the second stopper 230. In this case, as shown in FIG. 4, the first detachable groove 518 of the driving part 500 is fitted around the first detachable protrusion 108 of the coupling part 106 to fixedly lock the component 100.

Meanwhile, when releasing the locking state of the component 100, which is fixedly locked, the outer cap 300 is rotated counterclockwise. In this case, the guiding protrusion 420 forcibly goes beyond the first stopper 430 to move toward the insertion hole 222 (counterclockwise), or the vertical protrusion 312 forcibly goes beyond the second stopper 230 to move counterclockwise.

The operating part 400 and the driving part 500 inserted into the guiding groove 410 of the operating part 400 rotate counterclockwise as the guiding protrusion 420 rotates counterclockwise. In this case, the driving part 500 slides along the fixing guiding surface 212 while being away from the center by the elasticity of the elastic member 610, so that the driving part 500 is mounted in the fixing groove 210 as shown in FIG. 3. Accordingly, the first detachable groove 518 of the driving part 500 is separated from the first detachable protrusion 108 formed in the coupling part 106 as shown in FIG. 3, so that the component 100 may be separated from the inner cap 200.

Second Embodiment

The second embodiment has a structure in which the operating part 400 and the driving part 500 of the first embodiment are moved up and down in the state that the operating part 400 and the driving part 500 are fixedly locked to the component 100, so that a portion or an entire portion of the pumping part 102 or the coupling part 106 of the pipette 100 partially or entirely appears into the outer cap 300 or the inner cap 200, which makes a difference from the first embodiment in the structure of a reciprocation member.

Therefore, most components of the second embodiment are the same as those of the first embodiment except for the reciprocation member to sink the component 100. In addition, the second embodiment makes a difference from the first embodiment only in a portion of the reciprocation member. Accordingly, hereinafter, only the difference in the portion of the reciprocation member between the second and first embodiments will be described, and the whole structure of the second embodiment will be described based on the described of the operation thereof.

Figure 9:
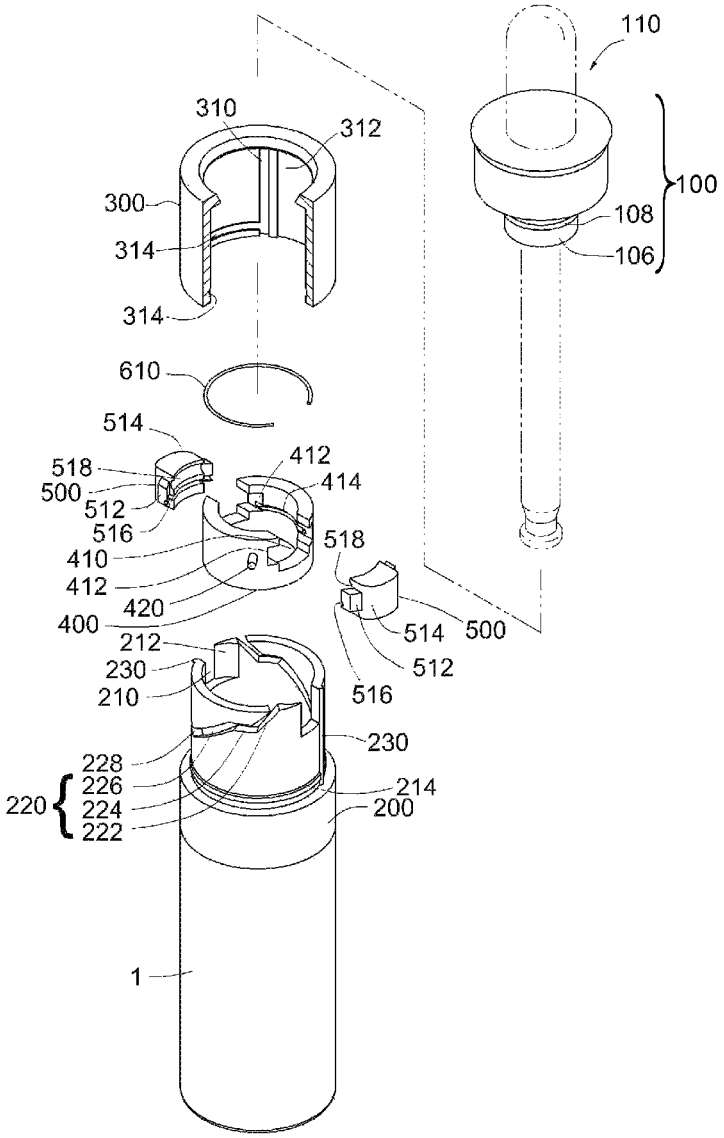
FIG. 9 is an exploded perspective view showing the structure according to a second embodiment of the present invention.

Although the guiding hole 220 according to the second embodiment is the same as that of the first embodiment in the structure of the insertion hole 222 and the driving hole 224, the second embodiment makes a difference from the first embodiment in that a up-and-down hole 226 extends downward of the end portion of the driving hole 224 in the form of an oblique line or a curved line as shown in FIG. 9 and a stopping hole 228 is horizontally formed from an end portion of the up-and-down hole 226.

Therefore, when the guiding protrusion 420 inserted into the guiding hole 220 passes through the up-and-down hole 226 via the driving hole 224, the operating part 400 and the driving part 500 are moved down.

According to the second embodiment, the first stopper 430 is molded in the form of a protrusion from one side of the stopping hole 228 to prevent the guiding protrusion 420 from being moved in a reverse direction after the guiding protrusion 420 has been moved to the one side. The second stopper 230 is molded in the form of a protrusion in the outer-diameter surface of the inner cap 200 while vertically extending as shown in FIG. 9, and the vertical protrusion 312 is molded from the inner-diameter surface of the outer cap 300 while vertically extending, thereby preventing the outer cap 300 from being rotated in the reverse direction after the outer cap 300 has gone beyond the second stopper through the rotation in one direction similarly to the first embodiment.

Figure 10:
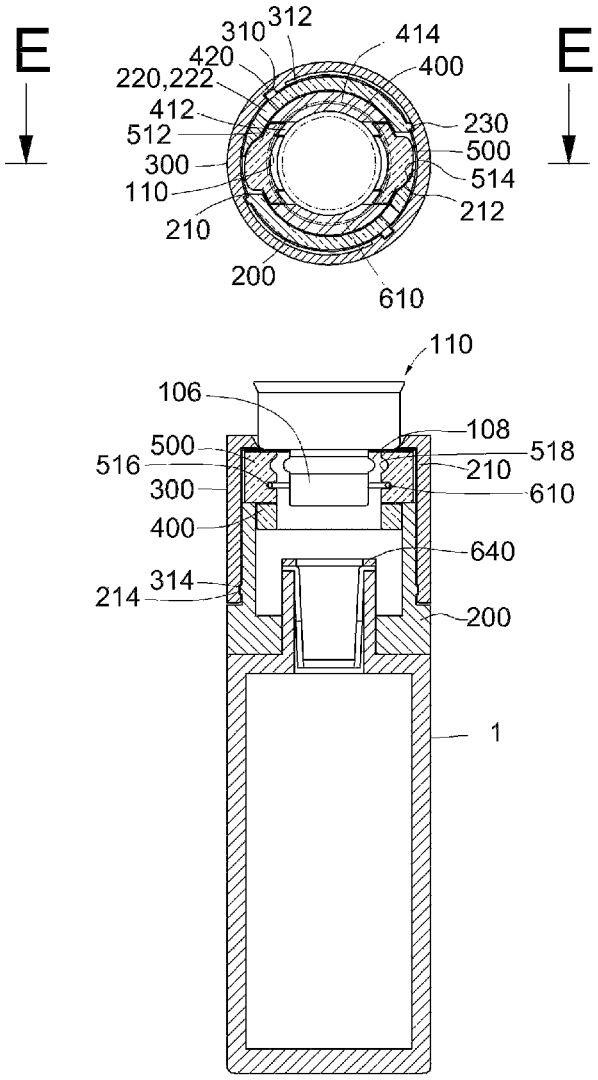
FIG. 10 illustrates a cross sectional view and an E-E line longitudinal sectional view showing the state that the component is separated from the vessel according to a second embodiment of the present invention.

Further, the operating part 400 and the inner cap 200 according to the second embodiment make a difference from the first embodiment in that the inner cap 200 is vertically lengthened or the operating part 400 is vertically shortened so that an empty space may be formed under the operating part 400 in the state that the operating part 400 is inserted into the inner cap 200, thereby ensuring the space in which the operating part 400 vertically moves up and down as shown in the longitudinal sectional view of FIG. 10.

In other words, since the guiding protrusion 420 of the operating part 400 is inserted into the driving groove 310 of the outer cap 300 through the guiding hole 220, when the guiding protrusion 420 moves along the up-and-down hole 226 of the guiding hole 220, the operating part 400 is moved up and down.

In other words, since the support parts 512 of the driving part 500 inserted into the guiding grooves 410 of the operating part 400 are inserted into the support holes 412 formed in both lateral sides of the guiding grooves 410 of the operating part 400. Accordingly, although the driving part 500 may be moved toward the center of a circle or outward as shown in FIG. 9, the driving part 500 may not be moved vertically. Accordingly, when force is vertically applied to the driving part 500, an effect that the operating part 400 is integrated with the driving part 500 may be made.

Therefore, in the state that the guiding protrusion 420 of the operating part 400 is inserted into the guiding hole 220, the positions of the operating part 400 and the driving part 500 in a vertical direction are determined depending on the position of the guiding protrusion 420 in the guiding hole 220. Accordingly, the operating part 400 and the driving part 500 may be moved up and down together.

Meanwhile, according to the second embodiment of the present invention, a detachable member to lock the component 100 inserted into the inner cap 200 or release the locking state of the component 100 has two examples.

First, a plurality of first detachable protrusions 108 circumferentially protrude on the outer-diameter surface of the coupling part 106 of the component 100, or one first detachable protrusion 108 may be formed while circumferentially extending.

Figure 11:
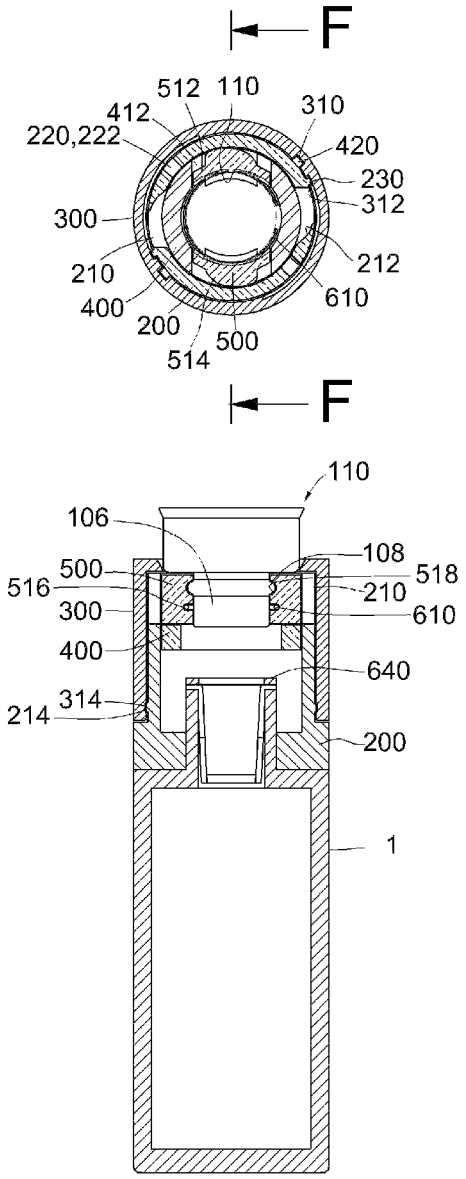
FIG. 11 illustrates a cross sectional view and a B-B line sectional view showing that the component according to the second embodiment of the present invention is fixedly locked.

In addition, a first detachable groove 518 is formed in an inner surface of the driving part 500 so that the first detachable groove 518 may be fitted around the first detachable protrusion 108. Accordingly, if the driving part 500 is moved in the central direction as shown in FIG. 11, the first detachable groove 518 is fitted around the first detachable protrusion 108, so that the driving part 500 may be fixedly coupled with the component 100.

Figure 14:
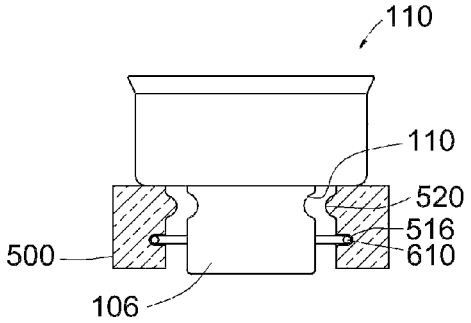
FIG. 14 is a view showing another example of the detachable member according to the second embodiment of the present invention.

Second, as shown in FIG. 14, at least one second detachable protrusion 520 protrudes from the inner surface of the driving part 500, and the second detachable groove 110 is circumferentially formed in the outer-diameter surface of the coupling part 106 of the component 100. Accordingly, if the driving part 500 is moved in the central direction as shown in FIG. 5, the second detachable protrusion 520 is inserted into the second detachable groove 110, so that the driving part 500 may be fixedly coupled with the component 100.

Hereinafter, the operating state of the second embodiment having the above structure will be described with reference to FIGS. 10 to 14.

First, as shown in the cross sectional view and the longitudinal sectional view of FIG. 3, the driving part 500 is away from the center of the driving part 500 so that the first detachable groove 518 of the driving part 500 is separated from the first detachable protrusion 108 formed on the coupling part 106 of the component 100. In this state, the component 100 may be separated from the vessel 1 or the used component 100 may be inserted into the vessel 1.

Therefore, if the component 100 is inserted into the vessel 1 through the inner cap 200 in the state shown in FIG. 10, a lower end portion of the component 100 is mounted on the upper end portion of the operating part 400 and maintained in a stationary state. In this case, the elastic member 610 elastically supports the driving part 500 in the state that the elastic member 610 is inserted into the first fitting groove 414 and the second fitting groove 516, so that the driving part 500 is away from the center. The end portion of the guiding protrusion 420 of the operating part 400 is located at a point at which the insertion hole 222 and the driving hole 224 of the guiding hole 220 meet together in the state that the end portion of the guiding protrusion 420 is fitted into the driving groove 310 of the outer cap 300.

In other words, according to the first and second embodiments, a force to continuously mount the driving part 500 in the fixing groove 210 is applied to the driving part 500 by the elasticity of the elastic member 610, so that the guiding protrusion 420 is located at a position at which the insertion hole 222 and the driving hole 224 meet.

Meanwhile, in order to fixedly lock the component 100 into the inner cap 200, as the guiding protrusion 420 fitted into the driving groove 310 and the operating part 400 integrated with the guiding protrusion 420 are rotated clockwise by rotating the outer cap 300 clockwise as shown in FIG. 11.

Accordingly, the driving part 500 inserted into the guiding groove 410 of the operating part 400 is rotated clockwise together with the operating part 400. Accordingly, the moving guiding surface 514 of the driving part 500 making contact with the fixing guiding surface 212 is rotated clockwise while making sliding-contact with the fixing guiding surface 212.

In this case, since the thickness of the fixing guiding surface 212 is gradually increased as shown in the cross sectional surface of FIG. 10, the driving part 500 more closely approaches the central part as the driving part 500 is rotated.

Therefore, if the guiding protrusion 420 is moved to the end portion of the driving hole 224 along the outer cap 300, the first detachable groove 518 of the driving part 500 is fitted around the first detachable protrusion 108 of the coupling part 106 as shown in FIG. 11 to fixedly lock the component 100.

In this case, if the outer cap 300 is more rotated clockwise, the guiding protrusion 420 fitted into the driving groove 310 and the operating part 400 are moved down while rotating along the up-and-down hole 226.

Figure 12:
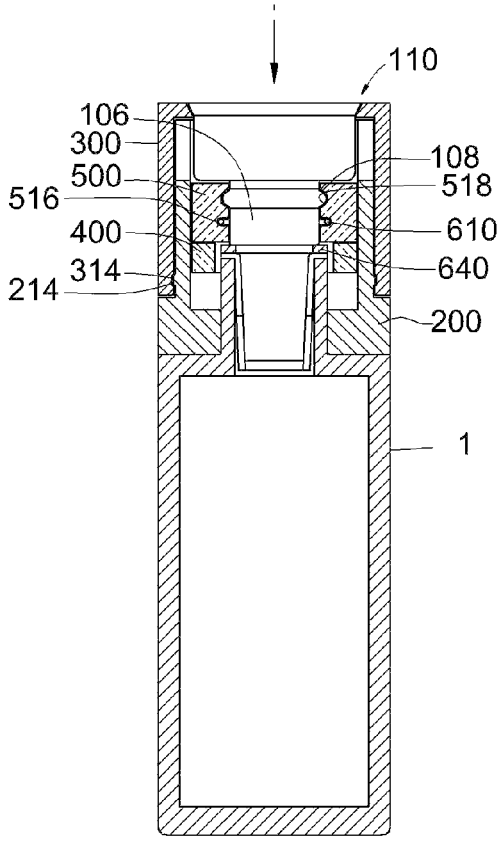
FIG. 12 is a longitudinal sectional view showing that the component according to the second embodiment of the present invention is sunken in the fixedly locked state.

In this case, the driving part 500 and the first detachable protrusion 108 of the coupling part 106 of the component 100 inserted into the first detachable groove 518, are moved down together as shown in FIG. 12.

Although FIG. 12 shows that the component 100 is fully sunken into the outer cap 300, a portion of the component 100 or the coupling part 102 may be sunken or an entire portion of the pumping part 102 may be sunken according to the intention of the inventor.

Figure 13:
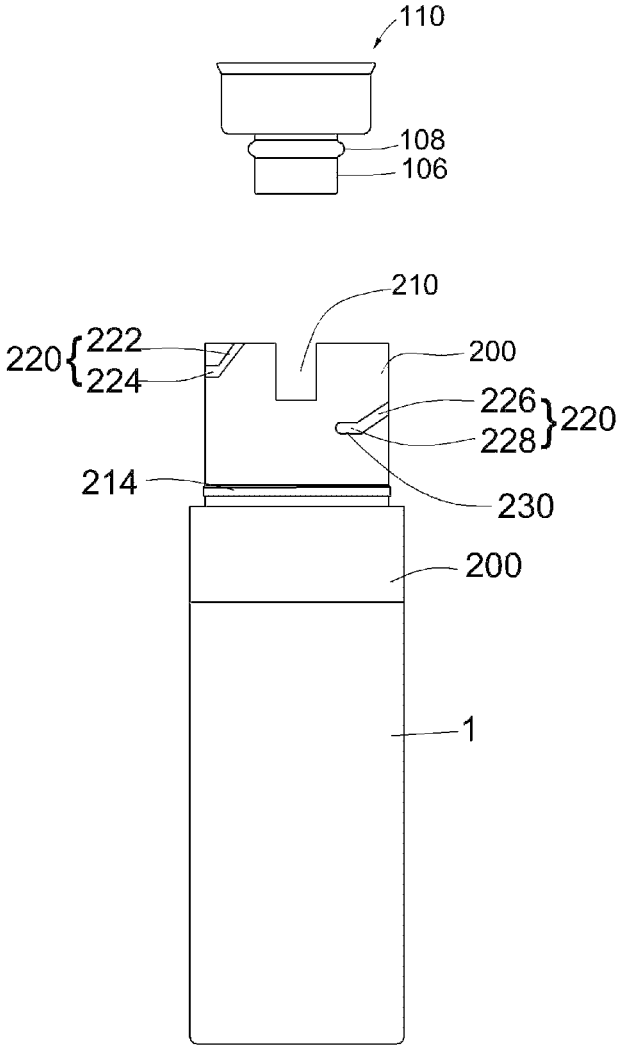
FIG. 13 is a front view showing that the component according to the second embodiment of the present invention is separated from the vessel.

In this case, as described above, if the guiding protrusion 420 enters the stopping hole 228 to move after the guiding protrusion 420 has been to the lower end portion of the up-and-down hole 226, the first stopper 430 formed in the stopping hole 228 can be prevented from forcibly going beyond the first stopper 430 formed in the stopping hole 228 and moving in the reverse direction as shown in FIG. 13. The second stopper 230 is molded in the form of a protrusion from the outer-diameter surface of the inner cap 200 while vertically extending as shown in FIG. 9, and the vertical protrusion 312 is molded at the inner-diameter surface of the outer cap 300 while vertically extending corresponding to the second stopper 230, thereby preventing the outer cap 300 from rotating in one direction to go beyond the second stopper 230 and then rotating in the reverse direction.

Meanwhile, in order to release the component 100, which is fixedly locked in the state that the component 100 is sunken into the outer cap 300 or the inner cap 200, the outer cap 300 is rotated counterclockwise. In this case, the guiding protrusion 420 goes beyond the first stopper 430 while moving toward the up-and-down hole 226 (counterclockwise) or the vertical protrusion 312 forcibly goes beyond the second stopper 230 while moving counterclockwise.

Therefore, the guiding protrusion 420 is moved up and down along the up-and-down hole 226 while rotating counterclockwise. Since the above state is a state that the first detachable protrusion 108 and the first detachable groove 518 are engaged with each other, as the operating part 400 and the driving part 500 are moved up and down, the component 100 is moved up and down together.

In addition, if the guiding protrusion 420 reaches the driving hole 224 above the up-and-down hole 226, the component 100 is in a complete protrusion state as shown in FIG. 11. In this case, if the outer cap 300 is more rotated counterclockwise, the guiding protrusion 420 is moved toward the insertion hole 222 along the driving hole 224 while the driving part 500 approximates the fixing groove 210. As the moving guiding surface 514 of the driving part 500 slides along the fixing guiding surface 212 by the elasticity of the elastic member 610, the driving part 500 is mounted in the fixing groove 210.

As described above, if the driving part 500 is mounted in the fixing groove 210, since the first detachable protrusion 518 is separated from the first detachable groove 108 as shown in FIG. 10, a user simply separates the component 100 from the vessel 1 to open the vessel 1.

Third Embodiment

According to the third embodiment, as the operating part 400 and the driving part 500 are moved up and down similarly to the second embodiment in the state that the operating part 400 and the driving part 400 are fixedly locked with the component 100, a portion or the entire portion of the component 100 partially or entirely appears from the inner portion of the outer cap 300 or the inner cap 200, which makes a difference in the structure of the reciprocating member between the second and third embodiments.

Therefore, although most parts of the structure of the third embodiment are the same as those of the structure of the second embodiment, the third embodiment makes a difference in the structure of the reciprocating member, in which the operating part 400, the driving part 500, and the component 100 appear, from the second embodiment.

Figure 15:
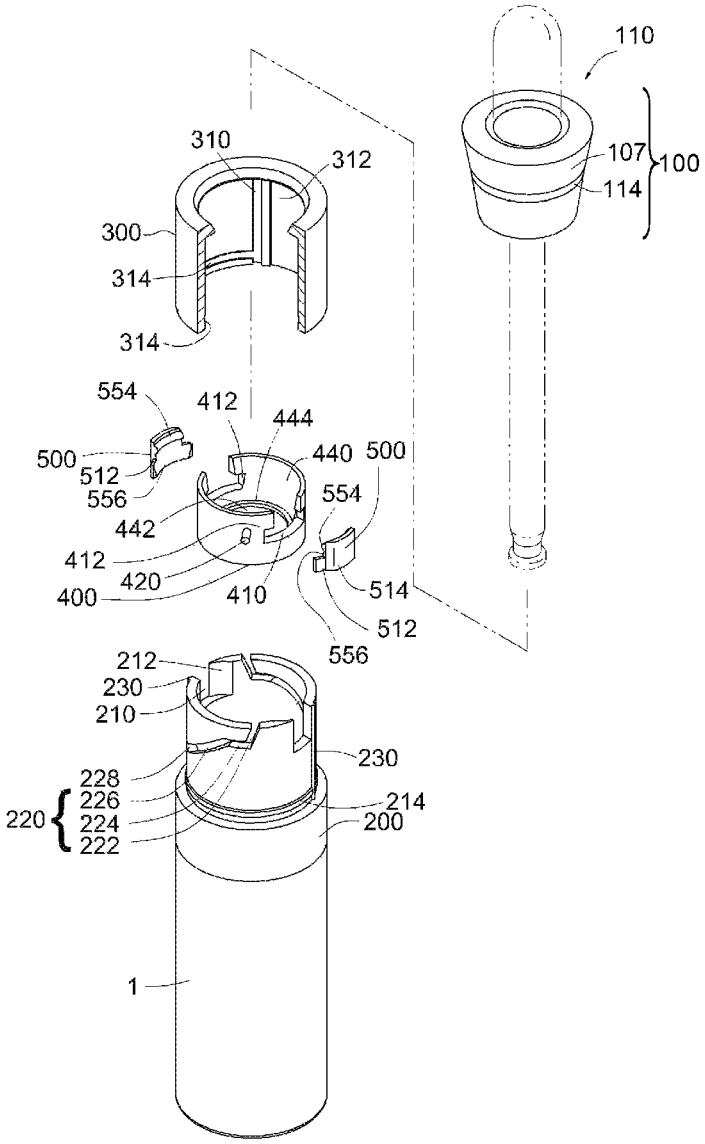
FIG. 15 is an exploded perspective view showing the structure of a third embodiment of the present invention.
Figure 16:
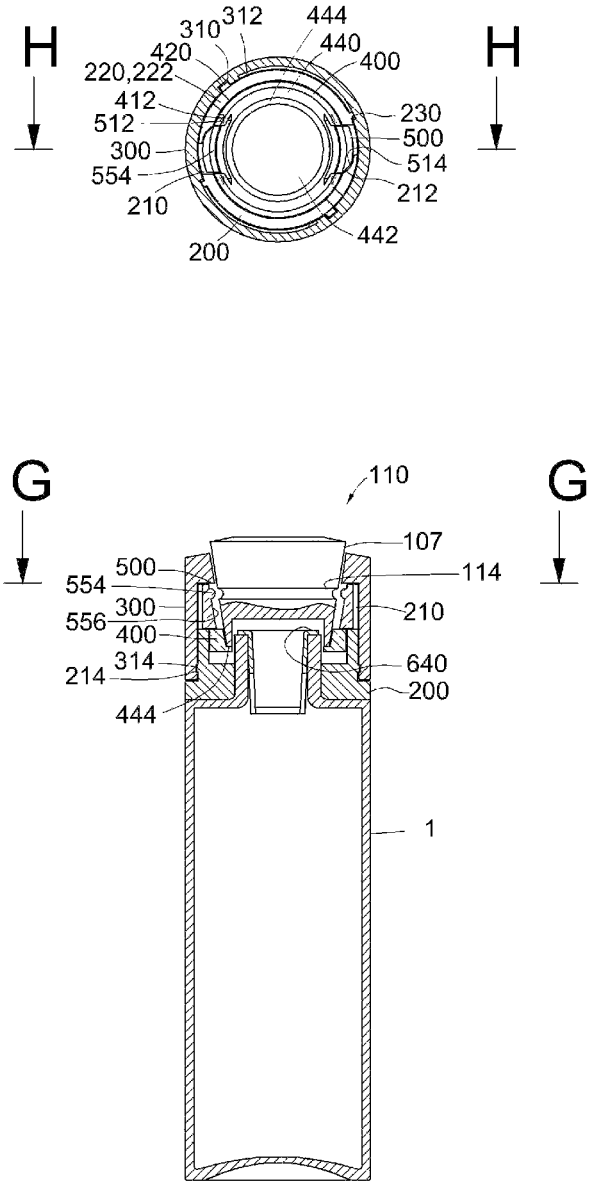
FIG. 16 illustrates a G-G line cross sectional view and a H-H line longitudinal sectional view showing the separating state of a component from a vessel according to a third embodiment of the present invention.

The operating part 400 according to the third embodiment has the same structure as that of the second embodiment. As shown in FIGS. 15 and 16, the operating part 400 has the shape of a cylinder with a wide top and narrow bottom, which has a first inclined surface 440 with a slop gradually narrowing the inner diameter of the cylinder. A support 444 having a predetermined width is formed at a peripheral portion of a through hole 442 formed in a lower end portion of the support 444 to support the bottom surface of the component 100.

Although the bottom surface of the component 100 may have a hollowed cylindrical shape as shown in FIG. 16, the bottom surface of the component 100 may have various shapes depending on the coupling structure between the inner cap 200 and the vessel 1 or the structure of upwardly protruding the upper end portion of the vessel 1, but the present invention is not limited thereto.

Further, the driving part 500 according to the third embodiment has the same structure as that of the second embodiment. The driving part 500 according to the third embodiment has a second inclined surface 55 with a slop increasing the thickness thereof toward the lower portion of the driving part 500 as shown in FIGS. 15 and 16. A fourth detachable protrusion 554 protrudes from the inner lateral side, that is, the second inclined surface 556.

Further, as shown in FIGS. 15 and 16, the component 100 is structured in the shape in which the size of the diameter is gradually reduced toward the lower portion of the component 100.

Therefore, the component 100 is provided at the outer-diameter surface thereof with a connection inclined surface 107. In this case, the slop of the connection inclined surface 107 is matched with the first inclined surface 440 of the operating part 400 and the second inclined surface 556 of the driving part 500 as described above.

Meanwhile, as described above, the structure of the guiding hole 220 according to the third embodiment, and the structure and the operation of the first stopper 430, the second stopper 230, and the vertical protrusion 312 are the same as those according to the second embodiment.

In addition, as shown in the longitudinal sectional view of FIG. 16, the operating part 400 and the inner cap 200 according to the third embodiment allows an empty space under the operating part 400 in the state that the operating part 400 is inserted into the inner cap 200, thereby ensuring a space in which the operating part 400 is vertically moved up and down.

Figure 17:
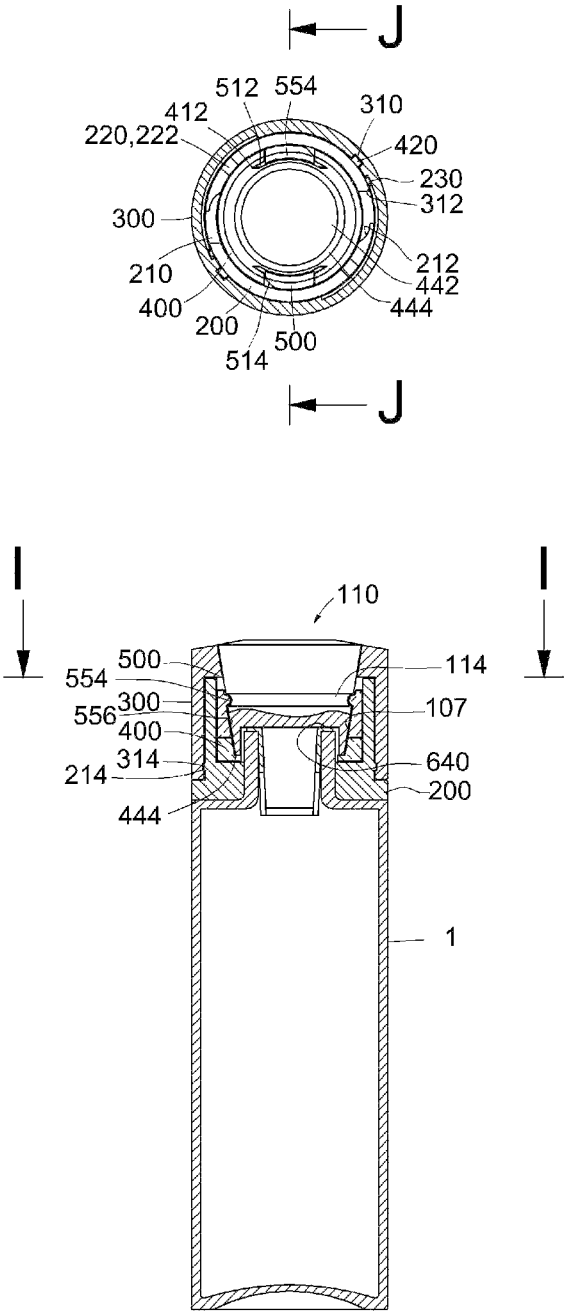
FIG. 17 illustrates an I-I line cross sectional view and a J-J line longitudinal sectional view showing the fixedly-locking state of the component according to the third embodiment of the present invention.

In addition, since the support parts 512 of the driving parts 500 are inserted into the support holes 412 formed at both lateral sides of the guiding grooves 410 of the operating part 400, the driving part 500 may be moved to a circular center or moved outwardly as shown in FIGS. 16 and 17, but may not be moved vertically. Accordingly, when force is vertically applied, an effect that the operating part 400 is integrally coupled with the driving part 500 may be made.

Meanwhile, a fourth detachable groove 114 is circumferentially formed in the connection inclined surface 107 formed on the outer-diameter surface of the component 100, and the fourth detachable protrusion 554 is formed in the second inclined surface 556 of the driving part 500. Accordingly, the fourth detachable protrusion 554 is inserted into the fourth detachable groove 114, so that the driving part 500 is fixedly coupled with the component 100.

Hereinafter, the operating state of the third embodiment having the above structure will be described with reference to FIGS. 16 and 17.

In the cross sectional view and the longitudinal sectional view of FIG. 16, the driving part 500 is away from the circular center so that the fourth detachable protrusion 554 of the driving part 500 is separated from the fourth detachable groove 114 of the component 100. In this state, the component 100 is separated from the vessel 1 so that the vessel 1 may be open.

Therefore, in the state of FIG. 16, if the component 100 is inserted into the inner cap 200, the connection inclined surface 107 is guided along the second inclined surface 556 of the driving part 500, or the first inclined surface 440 of the operating part 400. Accordingly, the lower end portion of the component 100 is mounted on the support 444 of the operating part 400 and maintained in a stationary state.

Meanwhile, in order to fixedly lock the component 100 to the inner cap 200, the guiding protrusion 420 fitted into the driving groove 310 and the operating part 400 integrated with the guiding protrusion 420 are rotated clockwise by rotating the outer cap 300 clockwise as shown in FIG. 17.

Therefore, the driving part 500 inserted into the guiding groove 410 of the operating part 400 is rotated clockwise together with the operating part 400, so that the moving guiding surface 514 of the driving part 500 making contact with the fixing guiding surface 212 slidably makes contact along the fixing guiding surface 212 while rotating clockwise.

In this case, since the thickness of the fixing guiding surface 212 is gradually increased as shown in the cross sectional surface of FIG. 16, as the driving part 500 may be rotated, the fixing guiding surface 212 is gradually closer to the circular center.

Therefore, if the guiding protrusion 420 is moved to the end of the driving hole 224 along the outer cap 300, the fourth detachable protrusion 556 of the driving part 500 is inserted into the fourth detachable groove 114 of the component 100 as shown in FIG. 17 to fixedly lock the component 100 (the component 100 is not shown in the cross sectional views of FIGS. 16 and 17).

In this case, if the outer cap 300 is more rotated clockwise, the guiding protrusion 420 fitted into the driving groove 310 and the operating part 400 are moved down along the up-and-down hole 226 while rotating.

In this case, the driving part 500, the fourth detachable groove 4 fitted around the fourth detachable protrusion 556 of the driving part 500, and the component 100 are moved down together as shown in FIG. 17.

In this case, if the guiding protrusion 420 is introduced into the stopping hole 228 and moved after the guiding protrusion 420 has been moved to the lower end portion of the up-and-down hole 226, the guiding protrusion 420 can be prevented from going beyond the first stopper 430 formed in the stopping hole 228 and being moved in a reverse direction as shown in FIG. 13 showing the second embodiment. The second stopper 230 is molded in the form of a protrusion in the outer-diameter surface of the inner cap 200 while vertically extending as shown in FIG. 15, and the vertical protrusion 312 is molded from the inner-diameter surface of the outer cap 300 while vertically extending, thereby preventing the outer cap 300 from being rotated in the reverse direction after the outer cap 300 has gone beyond the second stopper through the rotation in one direction.

Meanwhile, in order to release the component 100, which is fixedly locked in the state that the component 100 is sunken into the outer cap 300 or the inner cap 200, the outer cap 300 is rotated counterclockwise. In this case, the guiding protrusion 420 goes beyond the first stopper 430 while moving toward the up-and-down hole 226 (counterclockwise) or the vertical protrusion 312 forcibly goes beyond the second stopper 230 while moving counterclockwise.

Therefore, the guiding protrusion 420 is moved up and down along the up-and-down hole 226 while rotating counterclockwise. Since the above state is a state that the first detachable protrusion 108 and the first detachable groove 518 are engaged with each other, as the operating part 400 and the driving part 500 are moved up and down, the component 100 is moved up and down together.

In addition, if the guiding protrusion 420 reaches the driving hole 224 above the up-and-down hole 226, the component 100 is in a complete protrusion state as shown in FIG. 16. In this case, if the outer cap 300 is more rotated counterclockwise, the guiding protrusion 420 is moved toward the insertion hole 222 along the driving hole 224 while the driving part 500 approximates the fixing groove 210. As the moving guiding surface 514 of the driving part 500 slides along the fixing guiding surface 212 by the elasticity of the elastic member 610, the driving part 500 is mounted in the fixing groove 210.

As described above, the present invention relates to the structure of a cap coupled with a vessel. The component 100 attached to the cap can be easily and simply open and closed for the convenient use. In particular, as shown in FIGS. 2, 9, and 15, a pipette, a mascara stick, or a mascara brush is coupled with the component 100, so that an appliance coupled with the component 100 can be simply used.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cap structure of a vessel, which is coupled with the vessel to close or open the vessel, the cap structure comprising:

an inner cap having a cylindrical shape and coupled with an upper end portion of the vessel to open or close the vessel;

an outer cap having a cylindrical shape and fitted around an outer-diameter surface of the inner cap such that the outer cap is coupled with the inner cap;

a component inserted into the outer cap and the inner cap; and a detachable unit to fixedly couple the component with the inner cap or the outer cap or separate the component from the inner cap or the outer cap without separating the inner cap or the outer cap from the vessel, wherein the detachable unit comprises:

at least one fixing groove formed by downward incising an upper end portion of the inner cap with predetermined width and depth, and having a fixing guiding surface curved or obliquely provided and gradually enlarged from an outer-diameter surface toward an inner-diameter surface of an incised surface;

an operating part having a cylindrical shape, slidably inserted into an inner diameter of the inner cap, having at least one guiding groove formed by downward incising an upper end portion of the operating part with predetermined width and depth, having support holes formed in both lateral sides of the at least one guiding groove while passing through inner and outer diameters of the operating part at a predetermined depth, having a first inclined surface having a slope gradually narrowing the inner diameter in a wide-top and narrow-bottom shape, and having a support which is formed with a predetermined width at a peripheral portion of a through hole formed at a lower end portion of the operating part;

a driving part inserted into the at least one guiding groove of the operating part to reciprocate toward the at least one fixing groove and a center of the operating part, having support parts protruding in an arc shape from both lateral sides of the driving part such that the support parts are inserted into the support holes, having a second inclined surface with a slope increasing the thickness thereof toward a lower portion of the driving part, and having a fourth detachable protrusion protruding from an inner lateral side;

a reciprocating member to reciprocate the operating part;

a connection inclined surface formed at an outer-diameter surface of the component and having a slope reducing a size of a diameter toward a lower portion of the connection inclined surface; and a detachable groove circumferentially formed in the connection inclined surface.

2. The cap structure of claim 1, wherein the reciprocating member comprises:

at least one guiding hole having an insertion hole obliquely or vertically extending downward from the upper end portion of the inner cap, a driving hole horizontally or obliquely extending from the insertion hole, an up-and-down hole obliquely extending downward from an end portion of the driving hole, and a stopping hole horizontally extending from an end portion of the up-and-down hole;

at least one guiding protrusion protruding from an outer-diameter surface of the operating part at a position corresponding to a position of the at least one guiding hole such that the at least one guiding protrusion is inserted from an inside to an outside of the at least one guiding hole while protruding out of the at least one guiding hole;

a driving groove extending vertically upward from a lower end portion of an inner-diameter surface of the outer cap such that the at least one guiding protrusion protruding through the at least one guiding hole is inserted into the driving groove; and a moving guiding surface formed at one outer surface of the driving part corresponding to the fixing guiding surface of the inner cap such that the moving guiding surface makes sliding-contact with the fixing guiding surface.

3. The cap structure of claim 2, further comprising a first stopper protruding from one side of the driving hole to prevent the at least one guiding protrusion from being moved in a reverse direction after the at least one guiding protrusion has been moved to the one side of the driving hole.

4. The cap structure of claim 2, further comprising a second stopper protruding from the outer-diameter surface of the inner cap and vertically extending; and a vertical protrusion protruding from the inner-diameter surface of the outer cap while vertically extending to prevent the outer cap from being rotated in a reverse direction after the outer cap has been rotated in one direction and gone beyond the second stopper.

5. The cap structure of claim 1, wherein the outer cap has a locking groove formed in a lower end portion of an inner-diameter surface of the outer cap such that the locking groove is downward fitted around at least one fixing step protruding from a lower end portion of an outer-diameter surface of the inner cap.

* * * * *